US007779746B1

(12) United States Patent
Eiermann

(10) Patent No.: US 7,779,746 B1
(45) Date of Patent: Aug. 24, 2010

(54) STRESS LIMITING DIAPHRAGM FOR DIAPHRAGM AND BELLOWS PUMPS AND ACTUATORS

(76) Inventor: Robert Asher Eiermann, 19A Joanne Dr., Apt 2A, Ashland, MA (US) 01721

( * ) Notice: Subject to any disclaimer, the term of this patent is extended or adjusted under 35 U.S.C. 154(b) by 573 days.

(21) Appl. No.: 11/652,421

(22) Filed: Jan. 11, 2007

(51) Int. Cl.
*F01B 17/02* (2006.01)

(52) U.S. Cl. ..... 92/42; 92/35

(58) Field of Classification Search ..... 92/35, 92/42

See application file for complete search history.

(56) References Cited

U.S. PATENT DOCUMENTS

| | | | | |
|---|---|---|---|---|
| 1,341,669 | A * | 6/1920 | Porter | 92/42 |
| 6,468,056 | B1 | 10/2002 | Murakoshi | |
| 6,481,982 | B1 | 11/2002 | Yokomichi | |
| 6,544,005 | B2 | 4/2003 | Wade | |

OTHER PUBLICATIONS

Metal Bellows Compressor/Vacuum Pumps http://www.metalbellows.com/documents/OTS_Pumps-Compressors.pdf.
Metal Bellows Accumulators http://www.metalbellows.com/documents/Accumulators-Reservoirs.pdf.
Metal Bellows Actuators http://www.metalbellows.com/documents/PrimeMover.pdf.

* cited by examiner

*Primary Examiner*—F. Daniel Lopez

(57) ABSTRACT

The diaphragm profile 10 is defined by a computer generated compound radius 10*d* beginning at 10*f* and ending at 10*g*. The compound radius is generally governed by the equation:

$$\frac{\left(\frac{t}{2}\right)}{R} = \frac{\sigma}{E}$$

Figure 1:
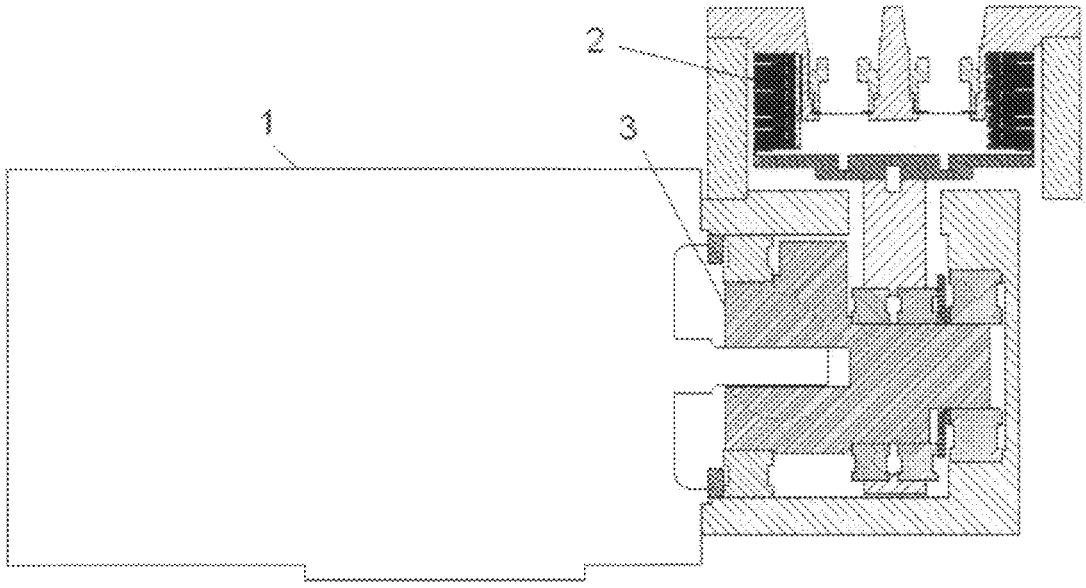
Figure 1 (Prior Art)

where,
t=Diaphragm Thickness
R=Radius of Curvature of Diaphragm Profile
σ=Stress from Flexure of Radius "R"
E=Modulus of Elasticity The profile limits diaphragm stresses to a prescribed and controlled level dictated by the initial formed profile of the diaphragm. As the bellows compresses, the gaps between adjacent diaphragm spans begin to close, thereby supporting the diaphragm and limiting further increases in stress. The remaining and shortened free span of each diaphragm is able to withstand the elevated pressures achieved during the compression process, ultimately offering a stable structure to the increase in loading.

A lubricious wear strip 11 is used to protect the diaphragm from undesired wear that could result from metal to metal contact between the diaphragms. A wear strip offset 13 accommodates the placement of the strip. The close spacing facilitated by the offset maintains a clearance given by Item 12 when the diaphragm is fully compressed, resulting in higher compression ratios where compressible fluids are pumped, and higher flow efficiencies where incompressible fluids are pumped.

9 Claims, 20 Drawing Sheets
(4 of 20 Drawing Sheet(s) Filed in Color)

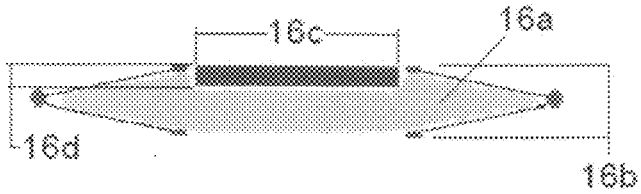

Figure 9

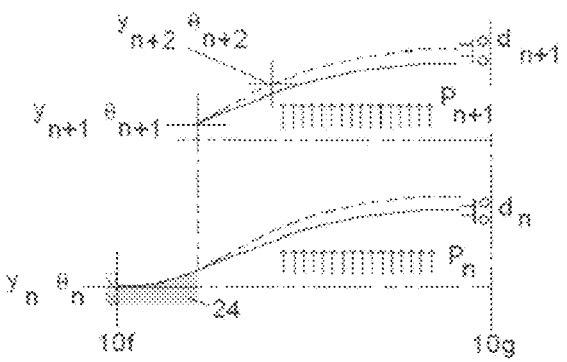

Boundary Conditions $\theta_n$ = Angular Rotation at Interval "n"

$\theta_{n+1}$ = Angular Rotation at Interval "n+1"

$y_n$ = Vertical Displacement at Interval "n"

$y_{n+1}$ = Vertical Displacement at Interval "n+1"

Applied Loads $d_n$ = Diaphragm Displacement at Interval "n"

$d_{n+1}$ = Diaphragm Displacement at Interval "n+1"

$P_n$ = Diaphragm Pressure at Interval "n"

$P_{n+1}$ = Diaphragm Pressure at Interval "n+1"

Figure 10

| K | L | M | N | O | P |
|---|---|---|---|---|---|
| Span Incremental Position and Boundary Condition | | | | | |
| Increment 1 | | | Increment 2 | | |
| b | 1.653 | in | b | 1.66 | in |
| $Y_b$ | 0.000 | in | $Y_b$ | -0.00028 | in |
| $\beta_b$ | -0.005 | rad | $\beta_b$ | -0.01013 | rad |
| Pressure | -1.8 | psig | $Y_b$ | 0.010 | in |
| y=diaphragm deflection (or stroke per diaphragm), β=edge rotation, N = # of convolutions | | | | | |

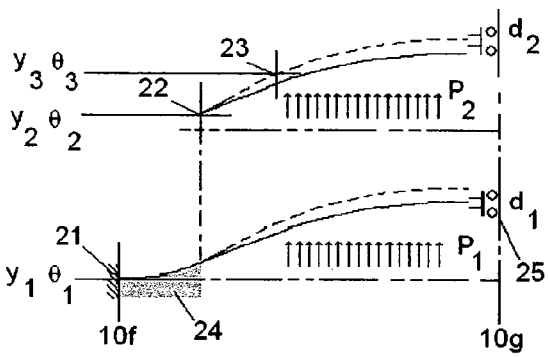

Boundary Conditions $\theta_1$ = Angular Rotation at Interval "1"

$\theta_2$ = Angular Rotation at Interval "2"

$y_1$ = Vertical Displacement at Interval "1"

$y_2$ = Vertical Displacement at Interval "2"

Applied Loads $d_1$ = Diaphragm Displacement at Interval "1"

$d_2$ = Diaphragm Displacement at Interval "2"

$P_1$ = Diaphragm Pressure at Interval "1"

$P_2$ = Diaphragm Pressure at Interval "2"

Figure 14

General Diaphragm Input

| | | |
|---|---|---|
| a | [illegible] | in |
| b | 1.625 | in |
| t | 0.0625 | in |
| Stress Limit | 60 | ksi |

Run Optimization

General diaphragm information such as inside and outside radii (b and a, respectively) are input, as well as thickness "t" and user defined stress in ksi. The analysis divides the span (a-b) into 20 evenly spaced increments. A deflection and pressure corresponding to the amount of compression of gas internal to the bellows are used to calculate span stresses. As the stresses begin to exceed the stress limit, those overstressed portions of the span are locked to prevent further stress from accumulating. Therefore, a diaphragm form may be designed to limit stresses due to a combination of deflection and pressure. See sheets "Coefficients", "Calculation @ r", and program Macro 1 for further description.

Span Incremental Position and Boundary Condition

| Increment 20 | | | Increment 21 | | |
|---|---|---|---|---|---|
| b | [illegible] | in | b | #REF! | in |
| y | [illegible] | in | y | #REF! | in |
| θ | [illegible] | rad | θ | #REF! | rad |
| Pressure | [illegible] | psig | y | 0.000 | in |

y= diaphragm deflection (or stroke per diaphragm), θ=edge rotation, N = # of convolutions

| | |
|---|---|
| θ | 0.0275 |
| r | |
| y | |
| θ | |
| M | |

Stress Data (psi)

| | |
|---|---|
| top | |
| bottom | |

| Radius | y | θ=edge rotation | Pr | Bottom Stresses in Remaining Span (psi) | | | | | | | | | | |
|---|---|---|---|---|---|---|---|---|---|---|---|---|---|---|
| | | | | 1.625 | 1.663 | 1.693 | 1.706 | 1.736 | 1.763 | 1.790 | 1.818 | 1.846 | 1.873 | 1.900 | 1.928 |
| 1.625 | 0.0000 | 0.0094 | -1.7 | [illegible] | [illegible] | [illegible] | [illegible] | [illegible] | [illegible] | [illegible] | [illegible] | [illegible] | [illegible] | [illegible] | [illegible] |
| 1.663 | 0.0001 | 0.0103 | -1.6 | | [illegible] | [illegible] | [illegible] | [illegible] | [illegible] | [illegible] | [illegible] | [illegible] | [illegible] | [illegible] | [illegible] |
| 1.693 | 0.0003 | 0.0107 | -1.4 | | | [illegible] | [illegible] | [illegible] | [illegible] | [illegible] | [illegible] | [illegible] | [illegible] | [illegible] | [illegible] |
| 1.706 | 0.0006 | 0.0108 | -0.9 | | | | [illegible] | [illegible] | [illegible] | [illegible] | [illegible] | [illegible] | [illegible] | [illegible] | [illegible] |
| 1.736 | 0.0011 | 0.0108 | -0.3 | | | | | [illegible] | [illegible] | [illegible] | [illegible] | [illegible] | [illegible] | [illegible] | [illegible] |
| 1.763 | 0.0017 | 0.0108 | 0.5 | | | | | | [illegible] | [illegible] | [illegible] | [illegible] | [illegible] | [illegible] | [illegible] |
| 1.790 | 0.0024 | 0.0109 | 1.5 | | | | | | | [illegible] | [illegible] | [illegible] | [illegible] | [illegible] | [illegible] |
| 1.818 | 0.0031 | 0.0110 | 3.0 | | | | | | | | [illegible] | [illegible] | [illegible] | [illegible] | [illegible] |
| 1.846 | 0.0039 | 0.0110 | 4.7 | | | | | | | | | [illegible] | [illegible] | [illegible] | [illegible] |
| 1.873 | 0.0047 | 0.0110 | 6.9 | | | | | | | | | | [illegible] | [illegible] | [illegible] |
| 1.900 | 0.0055 | 0.0111 | 9.8 | | | | | | | | | | | [illegible] | [illegible] |
| 1.928 | 0.0064 | 0.0111 | 13.1 | | | | | | | | | | | | [illegible] |
| 1.955 | 0.0072 | 0.0111 | 17.5 | | | | | | | | | | | | |
| 1.983 | 0.0080 | 0.0111 | 23.2 | | | | | | | | | | | | |
| 2.010 | 0.0087 | 0.0111 | 30.6 | | | | | | | | | | | | |
| 2.038 | 0.0094 | 0.0111 | 39.9 | | | | | | | | | | | | |
| 2.065 | 0.0100 | 0.0111 | 51.4 | | | | | | | | | | | | |
| 2.093 | 0.0105 | 0.0111 | 64.9 | | | | | | | | | | | | |
| 2.120 | 0.0109 | 0.0111 | 79.0 | | | | | | | | | | | | |

Figure 16a

| | Q | R | S | T | U | V | W | X | Y |
|---|---|---|---|---|---|---|---|---|---|
| 1 | Pressure, BDC | | 13 | psia | Dead | 0.56 | in | | |
| 2 | Pressure, TDC | | 100 | psig | | | | | |
| 3 | Diaph. Ctr @TDC | | 0.002 | in | | | | | |
| 4 | N | | 25 | | | | | | |
| 5 | Area | 11.341149 | | in | | | | | |
| 6 | Stroke | 0.661 | | in | | | | | |
| 7 | Req'd dia offset | 0.0112 | | in | | | | | |
| 8 | | | | | | | | | |
| 9 | | | | | | | | | |
| 10 | | | | | | 2.175 | | | |
| 11 | | | | | -0.011 | -0.011 | | | |
| 12 | | | | | -0.006 | 0.000 | | | |
| 13 | | | | | 1.797 | 1.863 | | | |
| 14 | | | | | | | | | |
| 15 | Maximum Stress = | | 80 | ksi | | | | | |
| 16 | | | | | [illegible] | [illegible] | | | |
| 17 | | | | | [illegible] | [illegible] | | | |
| 18 | | | | | | | | | |
| 19 | | | | | | | | | |
| 20 | ks0 | | | | | | | | |
| 21 | 1.965 | 1.983 | 2.010 | 2.038 | 2.065 | 2.093 | 2.120 | 2.148 | 2.175 |
| 22 | | | | | | | | | |
| 23 | [illegible] | [illegible] | [illegible] | [illegible] | [illegible] | [illegible] | [illegible] | [illegible] | [illegible] |
| 24 | [illegible] | [illegible] | [illegible] | [illegible] | [illegible] | [illegible] | [illegible] | [illegible] | [illegible] |
| 25 | [illegible] | [illegible] | [illegible] | [illegible] | [illegible] | [illegible] | [illegible] | [illegible] | [illegible] |
| 26 | [illegible] | [illegible] | [illegible] | [illegible] | [illegible] | [illegible] | [illegible] | [illegible] | [illegible] |
| 27 | [illegible] | [illegible] | [illegible] | [illegible] | [illegible] | [illegible] | [illegible] | [illegible] | [illegible] |
| 28 | [illegible] | [illegible] | [illegible] | [illegible] | [illegible] | [illegible] | [illegible] | [illegible] | [illegible] |
| 29 | [illegible] | [illegible] | [illegible] | [illegible] | [illegible] | [illegible] | [illegible] | [illegible] | [illegible] |
| 30 | [illegible] | [illegible] | [illegible] | [illegible] | [illegible] | [illegible] | [illegible] | [illegible] | [illegible] |
| 31 | [illegible] | [illegible] | [illegible] | [illegible] | [illegible] | [illegible] | [illegible] | [illegible] | [illegible] |
| 32 | [illegible] | [illegible] | [illegible] | [illegible] | [illegible] | [illegible] | [illegible] | [illegible] | [illegible] |
| 33 | [illegible] | [illegible] | [illegible] | [illegible] | [illegible] | [illegible] | [illegible] | [illegible] | [illegible] |
| 34 | [illegible] | [illegible] | [illegible] | [illegible] | [illegible] | [illegible] | [illegible] | [illegible] | [illegible] |
| 35 | [illegible] | [illegible] | [illegible] | [illegible] | [illegible] | [illegible] | [illegible] | [illegible] | [illegible] |
| 36 | | [illegible] | [illegible] | [illegible] | [illegible] | [illegible] | [illegible] | [illegible] | [illegible] |
| 37 | | | [illegible] | [illegible] | [illegible] | [illegible] | [illegible] | [illegible] | [illegible] |
| 38 | | | | [illegible] | [illegible] | [illegible] | [illegible] | [illegible] | [illegible] |
| 39 | | | | | [illegible] | [illegible] | [illegible] | [illegible] | [illegible] |
| 40 | | | | | | [illegible] | [illegible] | [illegible] | [illegible] |
| 41 | | | | | | | [illegible] | [illegible] | [illegible] |

26

27

Figure 16b

Figure 16f

```
Sub Macro1()
'
' The following Visual Basic program interacts with Excel worksheets "Span Condition",
' "Coefficients", and "Calculation @ r" to determine the radial profile of
' a bellows gas compressor diaphragm such that the superimposed stresses
' resulting from both increasing overall deflection and pressure are limited
' to a user defined level. Such a profile relies on support from the adjacent
' diaphragm such that as the bellows compresses, the deflection due to
' compression and pressure that would otherwise result in excessive stress
' in traditional, unsupported diaphragms is limited by the support of the
' adjacent diaphragms incurring identical and symmetric loading.
'
' The analysis commences by resetting all variables. The current condition
' diaphragm radius "b" (cell L3 of sheet "Span Condition") used for
' stress calculations begins at the inside radius of the diaphragm.
' The inside radius displacement boundary conditions "yb" and "theta b"
' are constrained, and therefore assigned a value of zero on the sheet
' "Span Condition".
'
    Cells(3, 12) = Cells(3, 2)
    Cells(4, 12) = 0
    Cells(5, 12) = 0
'
' The stress limit "strlim" is assigned a user define value from sheet
' "Span Condition", and initial stress and deflection values are assigned
' nominally small values.
'
    strlim = Cells(5, 2)
'
```

Figure 16f continued

```
  stroke1 = 0.000001
  stress1 = 0.001
  stroke2 = 0.001
  oldstroke = 0.0001
'
' The analysis performs stress calculations over 20 radial points on the
' diaphragm span, starting at interval "0", which denotes the inside radius
' of the diaphragm, and ending at the 19th increment, or one
' increment from the 20th increment, which represents the outside radius.
'
  For j = 0 To 19
'
' The diaphragm stroke is set to an initial value.
'
10  Cells(6, 15) = stroke2
'
' All previous span stress and deflection data are cleared.
'
  Range("B11:V13").Select
  Selection.ClearContents
'
' The increment is set by determining the current initial radial position "io".
' Note that the initial position migrates from the inside diameter to
' the outside diameter in 20 increments as the diaphragm form is defined.
' The calculations are performed from the current increment to the
' final increment corresponding to the outside diameter.
'
  io = Cells(9, 1)
'
' As the diaphragm form is defined, stresses and deflections of the remaining
' span are calculated. Note that the starting interval starts at io=2,
' but increases to 22 as the diaphragm form is defined.
```

Figure 16f continued

```
'
  For i = io To 22
'
' Assign the radial position to sheet "Calculation @ r" based on the current
' increment in order to calculate span stress and deflection.
'
' Note that sheet "Coefficients" automatically acquires information from
' input sheet "Span Condition" in order to calculate bending moments and
' shear force. Such calculations are required in order to obtain a complete
' closed form solution for stresses and deflections. Such bending moments and
' shear force data are used on sheet "Calculation @ r" to determine stress
' and deflection information at radial position "rx".
'
' Output stress and deflection data to sheet "Span Condition".
'
  Sheets("Calculation @ r").Cells(23, 2) = Cells(10, i)
  Cells(11, i) = Sheets("Calculation @ r").Cells(5, 10)
  Cells(12, i) = Sheets("Calculation @ r").Cells(6, 10)
  Cells(13, i) = Sheets("Calculation @ r").Cells(7, 10)
'
' Increase increment until all span stress and displacement data are defined.
'
  Next i
'
' Determine the maximum stress in the span at the given stroke.
'
  stress2 = Cells(15, 20)
'
' Verify that the maximum span stress is within 1 ksi of the maximum user
' defined limit "strlim" (cell B5). If the stress deviates from the limit
' by more than 1 ksi, extrapolate to a stroke level that will produce
' stresses closer to the user defined maximum level, and recalculate span
```

Figure 16f continued

```
' stress and deflections, beginning at line 10.
'
  If Abs(Abs(stress2) - strlim) > 1 Then
   m = 0.5 * (stroke2 - stroke1) / (stress2 - stress1)
   b = stroke2 - m * stress2
   stroke1 = stroke2
   stress1 = stress2
   stroke2 = m * strlim + b
  GoTo 10
  End If
'
' Save current deflection, pressure, and diaphragm stress data for the stroke
' interval.
'
  Range("B22:Y22").Select
  Selection.Copy
  Range(Cells(23 + j, 2), Cells(23 + j, 2)).Select
  Selection.PasteSpecial Paste:=xlPasteValues, Operation:=xlNone, SkipBlanks _
    :=False, Transpose:=False
'
  Range("B11:V11").Select
  Selection.Copy
  Range(Cells(75 + j, 2), Cells(75 + j, 2)).Select
  Selection.PasteSpecial Paste:=xlPasteValues, Operation:=xlNone, SkipBlanks _
    :=False, Transpose:=False
'
' Increase new starting interval, and associated inside radius deflection data,
' for the next interval condition. Transfer next interval data to current calculation
' status.
'
  Range("O3:O5").Select
  Selection.Copy
```

Figure 16f continued

```
    Range("L3").Select
    Selection.PasteSpecial Paste:=xlPasteValues, Operation:=xlNone, SkipBlanks _
        :=False, Transpose:=False
'
    Next j
'
End Sub
```

STRESS LIMITING DIAPHRAGM FOR DIAPHRAGM AND BELLOWS PUMPS AND ACTUATORS

CROSS REFERENCE TO RELATED APPLICATIONS

Not Applicable

FEDERALLY SPONSORED RESEARCH AND DEVELOPMENT

Not Applicable

REFERENCE TO COMPUTER PROGRAM

Figures and CD-ROM

BACKGROUND OF THE INVENTION

1. Field of the Invention

This invention relates to the shape of diaphragms to limit stresses when displacing liquids in single or multiple diaphragm pumps and actuators.

2. Background of the Invention

Diaphragms are generally single ply sheets or membranes 6*a* (FIG. 3) made from metal or plastic, cut into a circular or rectangular pattern. The innermost surface region of the diaphragm is either contiguous across the diameter, but more often is open to create an inside diameter edge 6*b*. The innermost and outermost edges 6*c* are welded, bonded, or mechanically fastened in a leak-tight fashion to the pump or actuator elements which produce (pump) or absorb (actuator) displacement of the inner or outer edges of the diaphragm. The relative motion between the inner and outer edges generates fluid pressure and/or flow in pump applications, or derives mechanical force and/or motion in actuator applications.

Pumps and actuators consisting of a single diaphragm are limited in displacement, and therefore, in overall performance. One method to increase the stroking capacity of the pump or actuator is to use a series of diaphragms joined at the inside 5*a* (FIG. 2) or outside 5 diameter edges. The edges may be welded, bonded, or mechanically fastened. To clarify terminology, a pair of diaphragms joined at either the inside or outside diameter edges is called a convolution. A series of convolutions each joined at the remaining free edge are called a bellows 2 (FIG. 1), or bellows capsule.

In pump and actuator applications, the objective is normally to compress the bellows when mechanical force or pressure is applied. Therefore, for pumps, a mechanical driver element 28 (FIG. 17) located outside the bellows compresses the bellows and squeezes the driven fluid 29 contained within the bellows cavity. In actuator applications, the bellows is encapsulated by a leak tight housing or pressure vessel 34 (FIG. 18). The driving fluid 31 is normally contained between the bellows and vessel, such that when pressure is applied to the fluid, the bellows compresses to move a driven element 32 located inside the bellows.

The proposed art is specific design features of a diaphragm to limit diaphragm stresses in single or multiple diaphragm, or bellows, applications. For subject matter related to the design of individual diaphragms in either a single or multiple diaphragm application, a diaphragm will be subsequently referenced. The end application for the diaphragm design, however, may be a single diaphragm pump, multiple diaphragm (bellows) pump, a single diaphragm actuator, or a multiple diaphragm (bellows) actuator.

The novelty of the proposed art is equally advantageous for pump and actuator applications of single or multiple diaphragm construction. Please note however, that in pump applications, the fluid is contained within the bellows as stated above, and to be advantageous, the diaphragm contour and offset proposed in this specification is located at the innermost radial region 30 (FIG. 17) of the diaphragm. In actuator applications, the fluid is contained outside the bellows, and the diaphragm contour and offset proposed in this specification is located at the outermost radial region 33 (FIG. 18) of the diaphragm. For the purposes of simplifying the specification, a bellows pump will be subsequently referred to as the target application for the proposed art, and as such, the novel design features will be located at the innermost radial region 30. However, the effort to simplify the discussion does not preclude application to an actuator, where the proposed design features are located at the outermost radial region 33 to gain equally advantageous benefits.

Bellows pumps are four stroke reciprocating machines that convey fluids by elongating and contracting the bellows capsule 2 (FIG. 1), therefore displacing fluid volume within the bellows cavity and generating fluid flow and pressure. Such pumps or particularly useful where the conveyed fluid cannot be contaminated by lubricating oil and wear particles, or where the fluid cannot leak across sliding piston seals. Recently, bellows pumps have been employed in industries such as semiconductor process fluid distribution and cryogenics, where fluids must remain very pure, or where leakage of toxic, corrosive agents is not acceptable.

Pump bellows may be categorized as either corrugated one piece construction, where the corrugations are created in a molding or forming process, or by edge welded metal diaphragms, where corrugated diaphragms 4 (FIG. 2) are typically joined by a weld bead 5 at the inside diameter to create the convolution, or pair of diaphragms, as discussed previously. The convolutions are then joined at the outside diameters to create a pleated, expandable capsule. Corrugated tube bellows may be constructed of plastic or metal, and are easier to manufacture than their welded counterparts, but typically do not possess higher performance characteristics such as flexibility and pressure capacity of edge welded designs, and therefore, are usually employed in lower performance applications where fluid pressure is used to actuate the bellows, or in crankshaft driven applications where low flow and compression ratios are permissible.

Higher performance crankshaft driven bellows pumps typically use corrugated edge welded diaphragms due to the greater latitude to create a shape tolerant to high levels of cyclical flexure and pressure. Of primary concern are the flexure and pressure stresses generated by compression of the bellows capsule during the reciprocation process. As the capsule compresses, the diaphragms deflect, resulting in increased displacement induced flexural stresses at the inside and outside diameters of the diaphragms. Fluid pressure also increases as the bellows internal volume reduces, given by the poly-isentropic relationship between fluid pressure and volume, where an ideal gas is the selected fluid.

$$P_1/P_2=(V_2/V_1)^k \qquad \text{(Equation 1)}$$

Where,

P=Fluid pressure at two distinct points of the reciprocation process,

V=Bellows internal volume at the distinct reciprocation points, and k=Isentropic or poly-isentropic coefficient of the fluid conveyed.

For and incompressible fluid, other relationships related to the viscosity of the fluid and the change in volume over time, or volumetric flow rate, would apply.

$$P=f(\nu,Q)$$

Where,

ν=Fluid Viscosity, and

Q=Volumetric Flow Rate (ΔV/Δt).

The fluid pressure also generates stresses throughout the diaphragm, which typically add to deflection stresses at the inside diameter, and subtract from deflection stresses at the outside diameter. The stress combination particularly at the inside diameter can significantly limit the pressure range of the bellows, as the cyclic nature of the combined deflection and pressure stresses may produce considerable fatigue damage.

The prior art of crankshaft driven edge welded bellows pumps is generally limited to pressure below 100 psi, due to the high stresses on the unsupported diaphragm spans resulting from both fluid pressure and deflections exercised during the fluid compression process, particularly at the inner diameter location of the diaphragm as discussed above. Where higher pressures approaching 100 psi are attainable, diaphragm material selection is limited to highly fatigue resistant materials such as non-heat treated AM-350 stainless steel to mitigate cyclic fatigue damage. However, such materials are limited in corrosion resistance, and are not suitable for certain corrosive process applications. Additionally, pressures in excess of 100 psi typically require that the bellows or diaphragm be externally air or fluid driven 6 (FIG. 3) to counteract the high pressures internal to the diaphragm. However, such designs are more costly, pump at slower rates, may require a second stage, and therefore would require a supplemental system 7 to regulate and control pressure on the secondary fluid driving side of the diaphragms.

In addition to structural problems under relatively high pressures, traditional edge welded bellows pumps are typically unable to achieve high pressures without the use of two stages 8 (FIG. 4) coupled with a crossover pipe 9. Most bellows require substantial spacing between diaphragms to prevent cyclical galling from inadvertent diaphragm contact, and from a basic practical perspective, for weld bead clearance. As a result, a substantial uncompressed dead volume may drastically reduce overall compression ratio, resulting in poor efficiency and fluid output. Consequently, pumps typically require multiple stages at increased product cost to achieve overall desired system compression ratios.

3. Objects and Advantages

The objects and advantages of the proposed invention are:

a) An engineered diaphragm shape that contacts adjacent diaphragms at the onset of a predefined stress limit, thereby reducing the unsupported span of the diaphragms, and preventing further increases in diaphragm stress in the fully contacted portions of the diaphragm span.

b) A unique diaphragm shape having the ability to inherently control stresses as said in paragraph "a" above throughout all intervals of the compression cycle, thereby permitting a wider range of materials to be considered for fatigue and other non-fatigue design requirements, such as, but not limited to, corrosion resistance.

c) A unique diaphragm shape as described in paragraphs "a" and "b" above that will permit higher pressures to be employed due to the progressive stress mitigating nesting under deflection and associated pressure.

d) Lubricious wear strips that prevent galling and premature wear of the diaphragms under the cyclic contact of paragraph "c".

e) A wear strip offset incorporated in to the diaphragm shape that places the wear strip between the diaphragms. The offset also permits higher compression ratios in the presence of enlarged weld beads, as a result of the minimal unstroked fluid dead volume inherent in the design, ultimately achieving higher pump performance at significantly less cost.

Further objects and advantages of my design will become apparent from a consideration of the drawings and ensuing description.

BRIEF SUMMARY OF THE INVENTION

The proposed invention limits bellows pump diaphragm stress by engineering a diaphragm shape that progressively distributes contact support between adjacent diaphragms as stresses in the deflecting diaphragms begin to exceed a user defined stress limit. In addition to creating a stress limiting, fatigue resistant design, the closely contacting diaphragms inherently maximize displaced fluid volume within the capsule. Reduction in unstroked dead volume greatly enhances compression ratio and pump efficiency, further reducing product cost to achieve a given performance objective.

DRAWINGS

Figures

The file of this patent contains at least one drawing executed in color. Copies of this patent with color drawing(s) will be provided by the Patent and Trademark Office upon request and payment of the necessary fee.

FIG. 1 General Depiction of a Reciprocating Bellows Pump (Prior Art)

Figure 2:
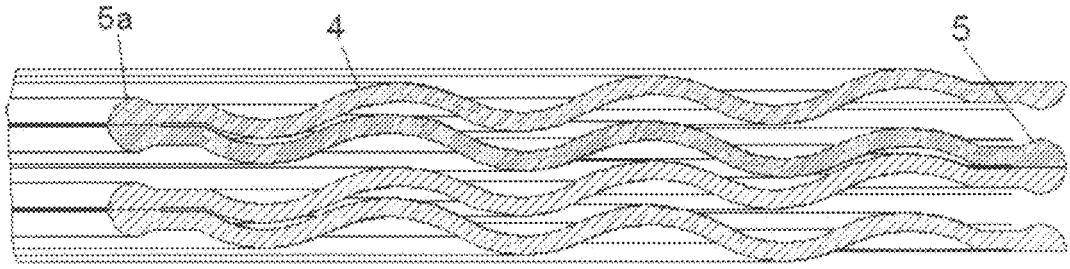
Figure 2 (Prior Art)

FIG. 2 Corrugated Edge Welded Bellows Radial Cross-Section (Prior Art)

Figure 3:
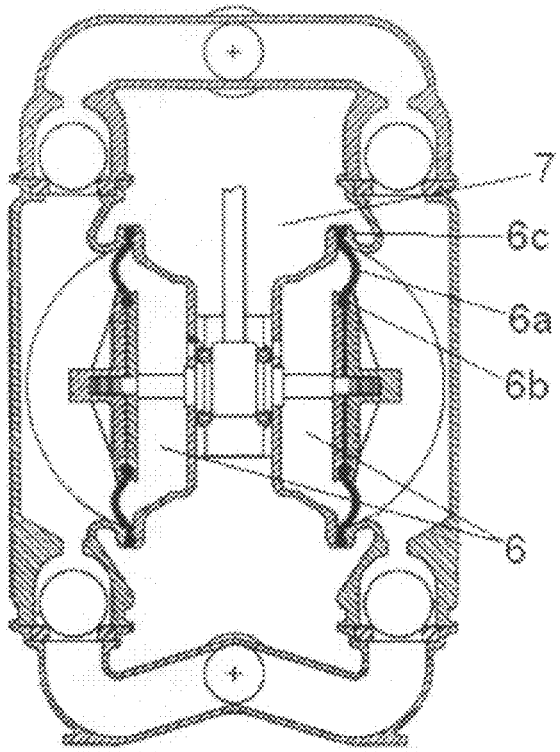
Figure 3 (Prior Art)

FIG. 3 Diaphragm Pump (Prior Art, http://www.wilden-pump.com)

Figure 4:
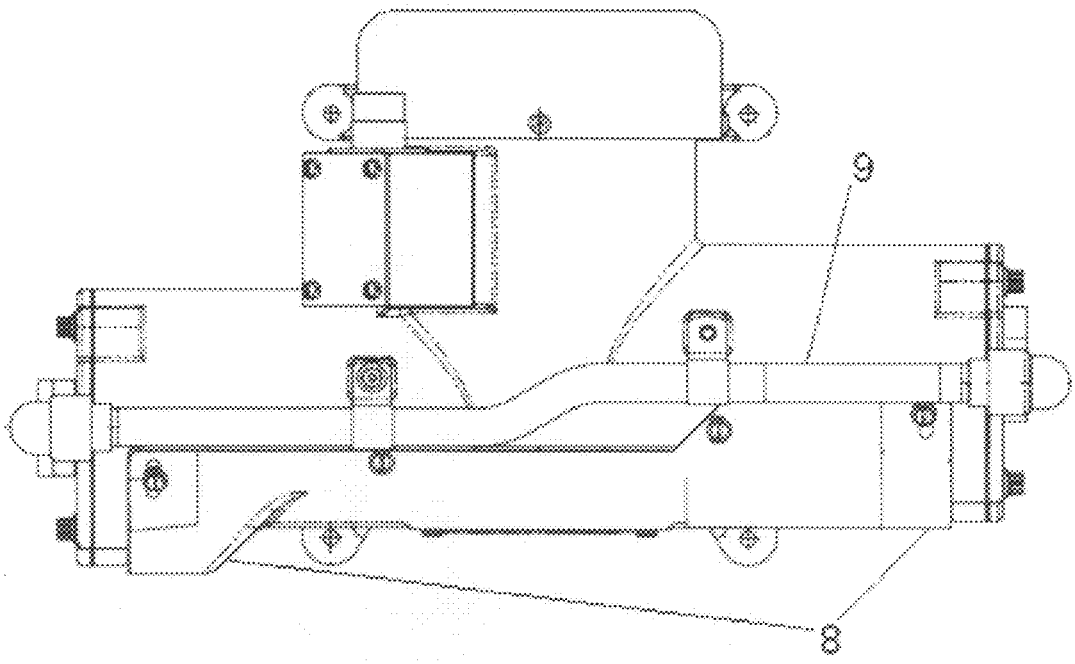
Figure 4 (Prior Art)

FIG. 4 Two Stage Bellows Pump (Prior Art, http://www-.metalbellows.com)

Figure 5:
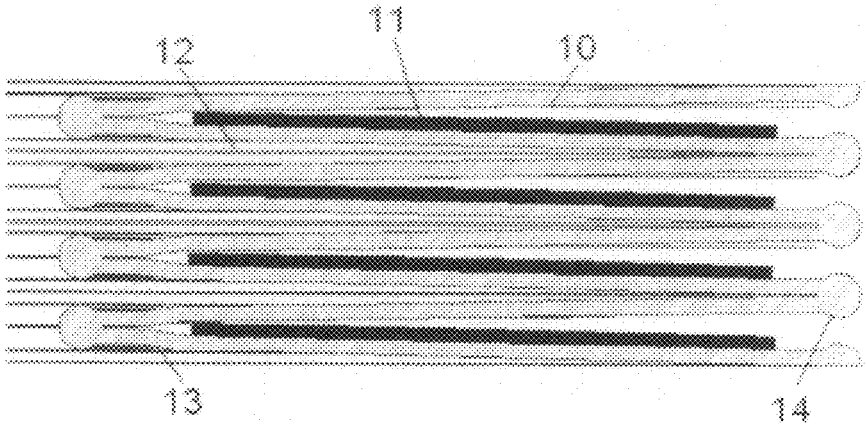

FIG. 5 Stress Limiting Bellows Design Radial Cross-Section (Proposed Art)

Figure 6:
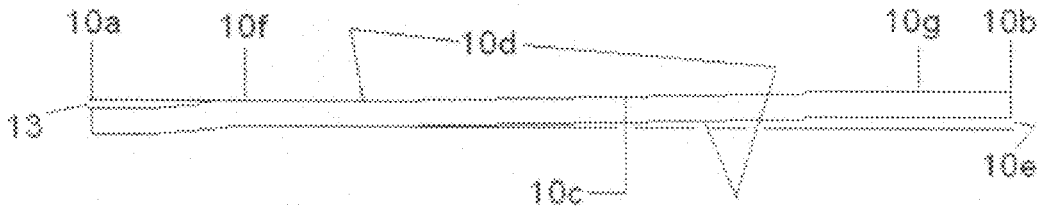

FIG. 6 Diaphragm Stress Limiting Shape Definition (Proposed Art)

Figure 7:
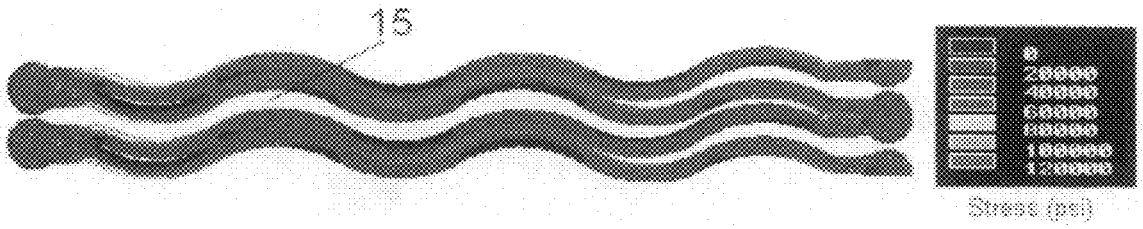
Figure 7 (Prior Art)
Figure 8A:
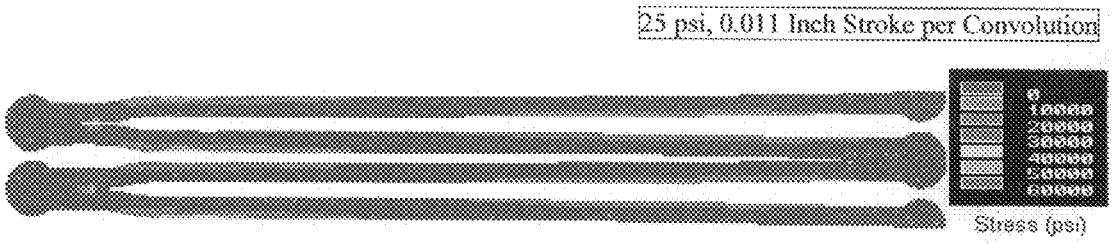
Figure 8B:
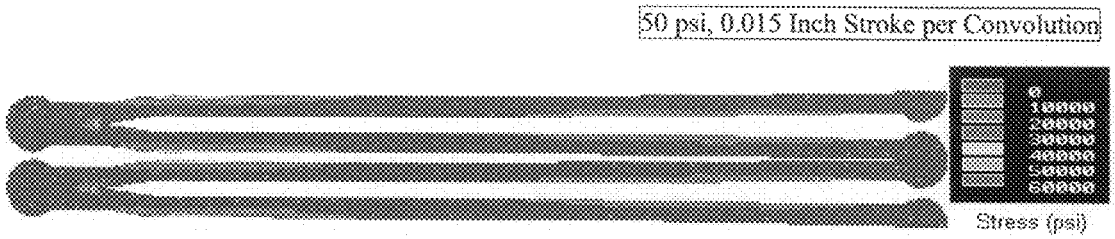
Figure 8C:
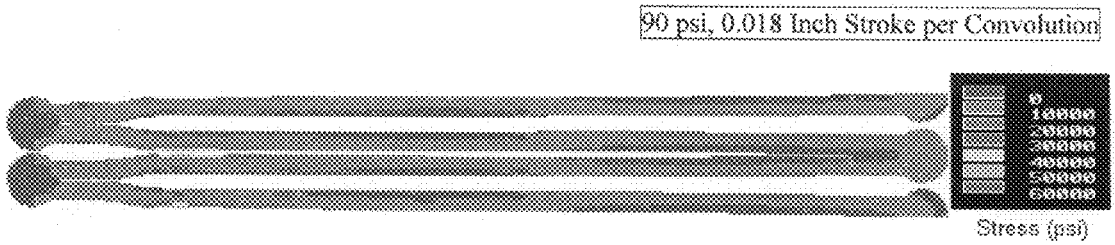
Figure 8D:
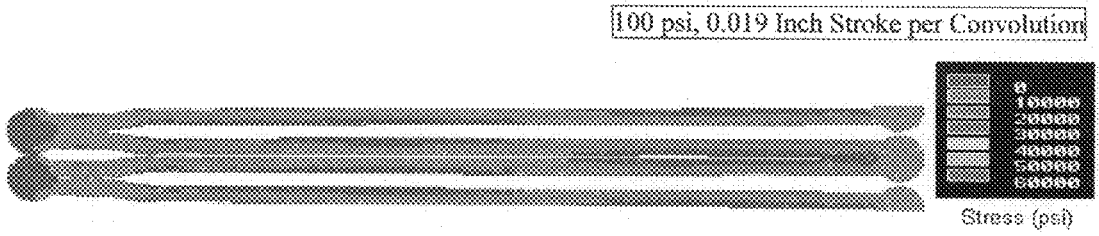
Figure 11:
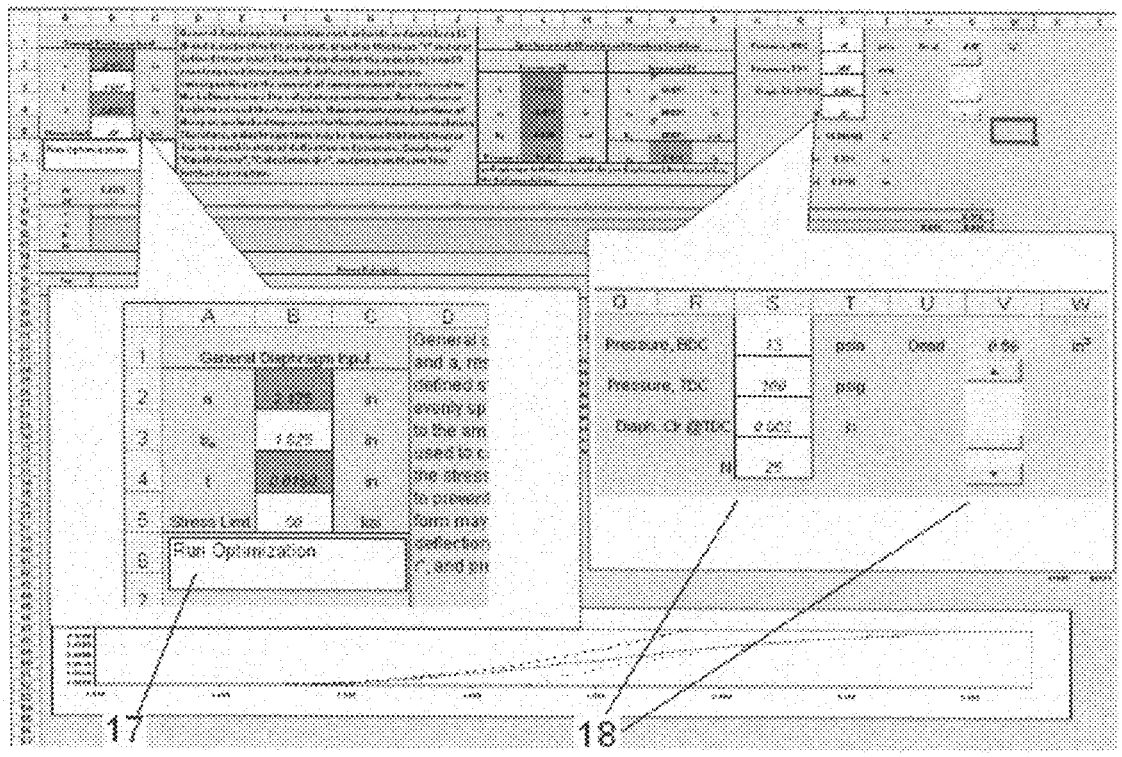
Figures 12, 13:
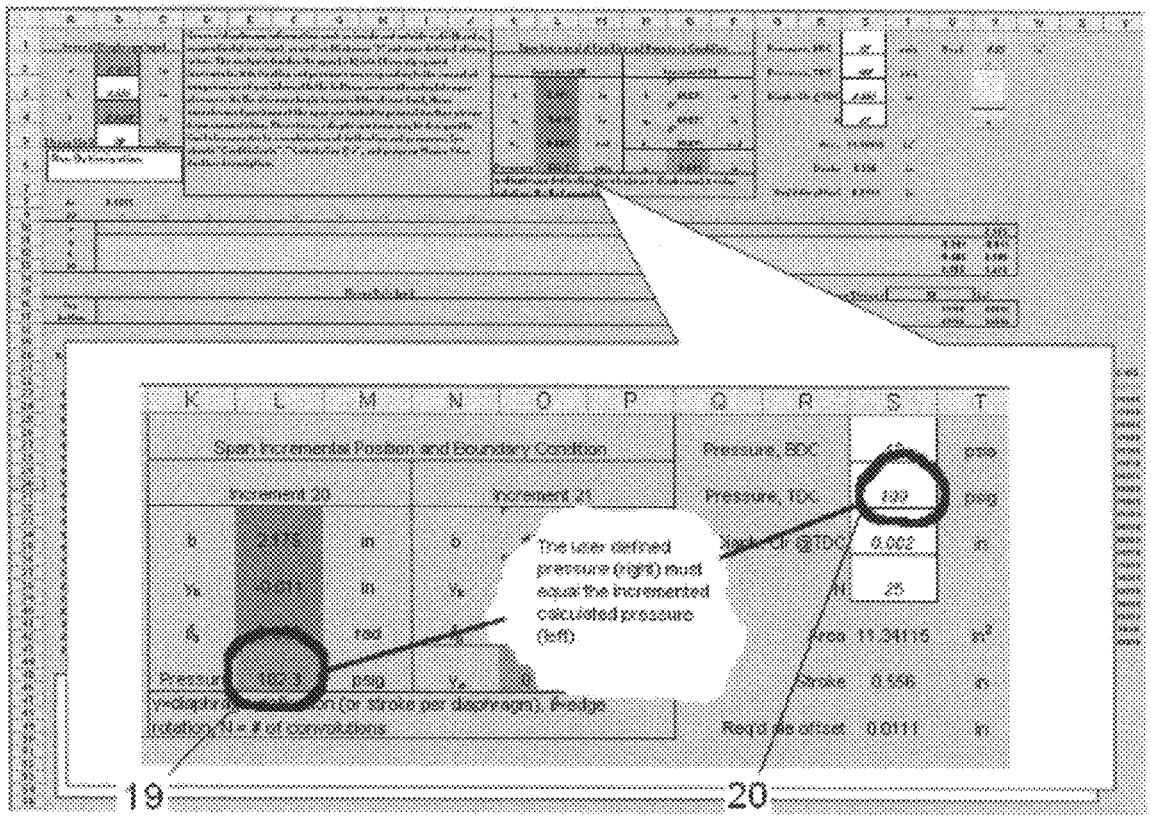
Figure 15:
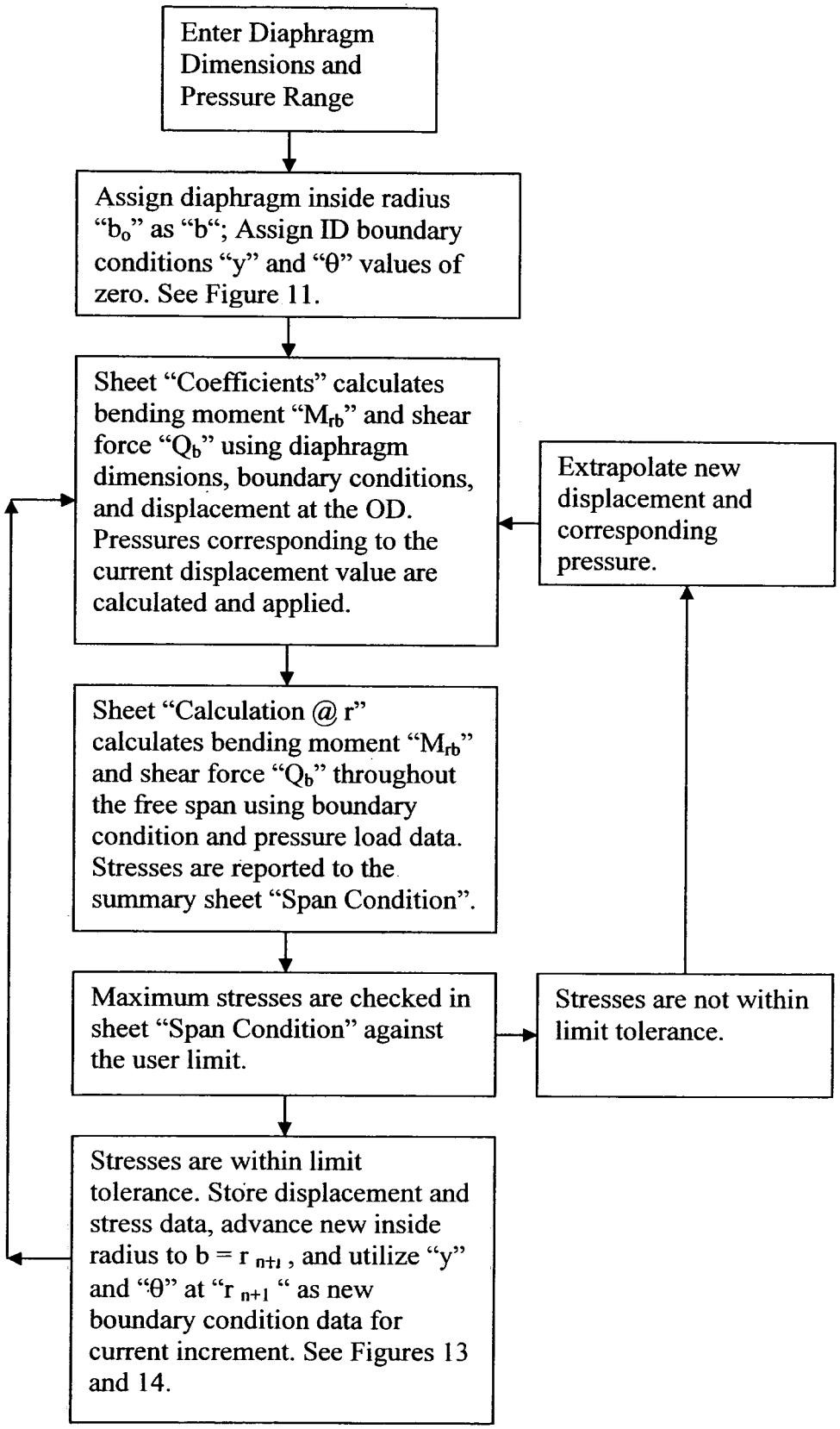
Figure 16C:
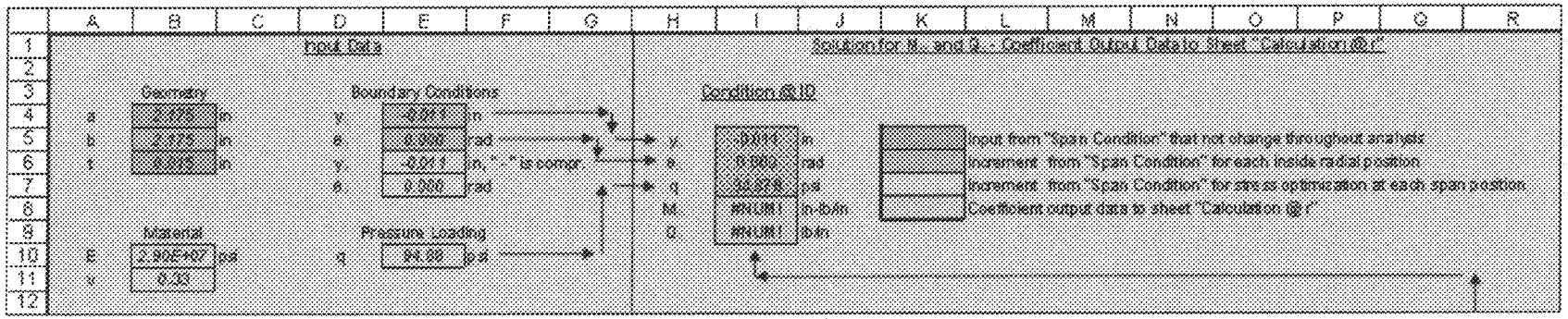
Figure 16D:
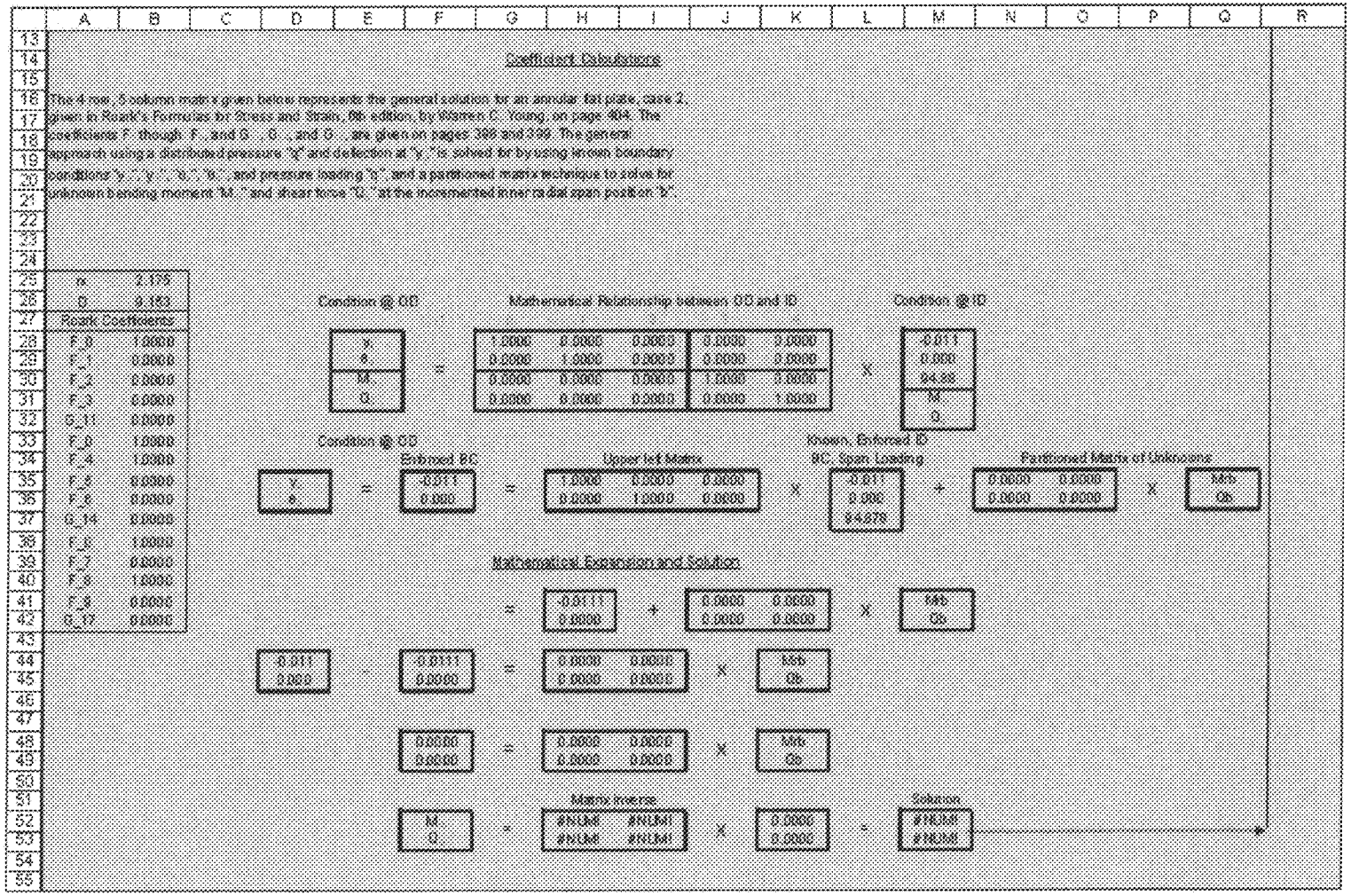
Figure 16E:
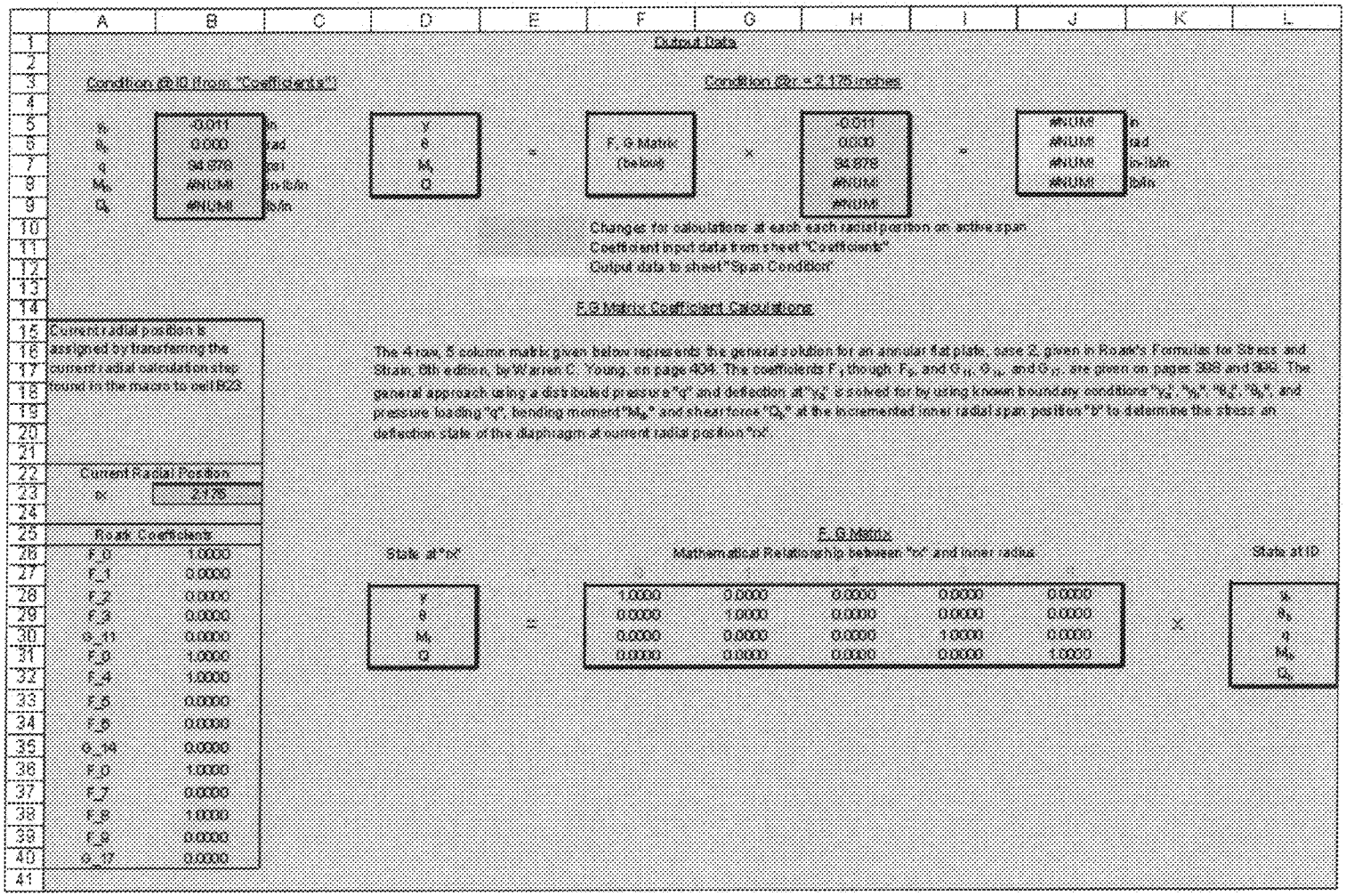

FIG. 7 Finite Element Analysis Example of Prior Art Diaphragms, 100 psi Internal Pressure, 0.019" Compression per Convolution FIG. 8*a* Finite Element Analysis Example of Proposed Art Stress Limiting Diaphragms—25 psi, 0.011 Inch Stroke per Convolution FIG. 8*b* Finite Element Analysis Example of Proposed Art Stress Limiting Diaphragms—50 psi, 0.015 Inch Stroke per Convolution FIG. 8*c* Finite Element Analysis Example of Proposed Art Stress Limiting Diaphragms—90 psi, 0.018 Inch Stroke per Convolution FIG. 8*d* Finite Element Analysis Example of Proposed Art Stress Limiting Diaphragms—100 psi, 0.019 Inch Stroke per Convolution FIG. 9 Fluid Volume Contained Within Diaphragms FIG. 10 Diaphragm Loading and Stress Calculation Sequence FIG. 11 General Input to Profile Algorithm Software FIG. 12 Verification of Pressure Agreement by Dead Volume Adjustment FIG. 13 New Boundary Conditions Assigned from Prior Interval Free Span Data FIG. 14 Graphical Representation of Second Interval Boundary Condition Assignment FIG. 15 Diaphragm Stress Limiting Profile Computer Program Flow Chart FIGS. 16*a*-16*f* Diaphragm Stress Limiting Profile Computer Program Listing (MS Excel and Visual Basic)

Figure 17:
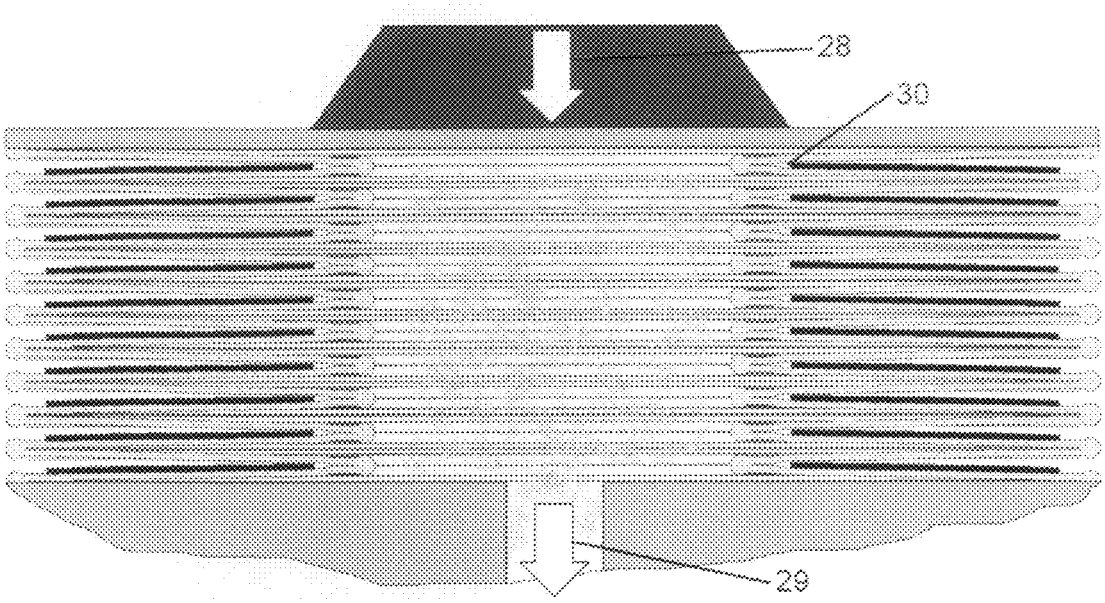
Figure 18:
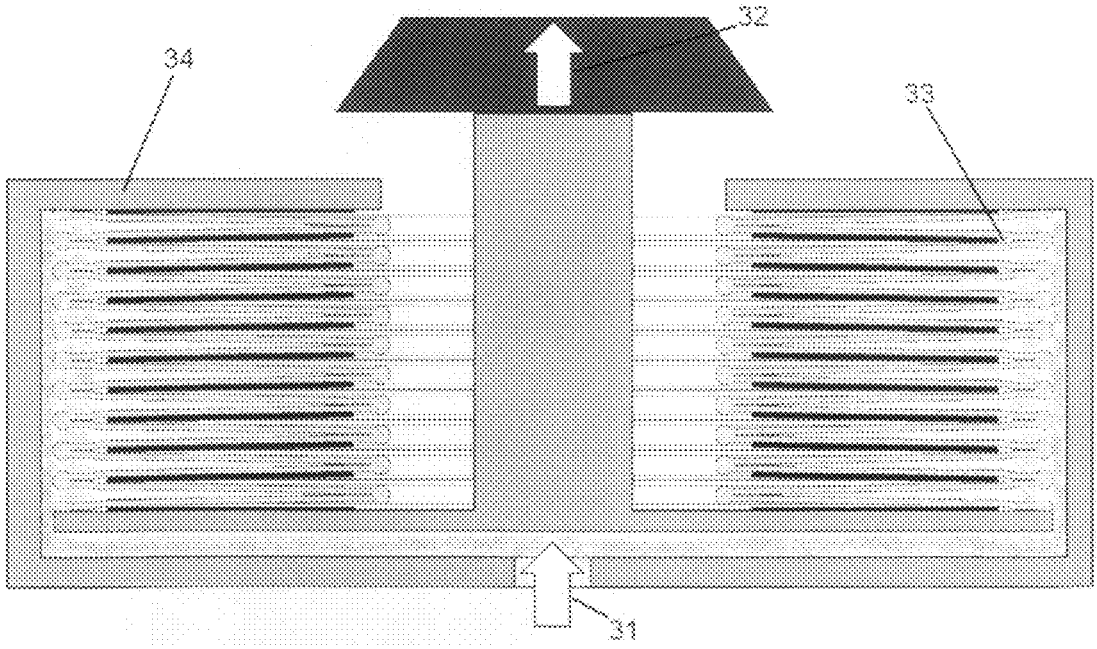

FIG. 17 Configuration of Proposed Art in a Bellows Pump Application

FIG. 18 Configuration of Proposed Art in a Bellows Actuator Application

| DRAWINGS - Reference Item Numerals | | | |
|---|---|---|---|
| 1 | Pump Motor (Prior Art) | 2 | Bellows Capsule (Prior Art) |
| 3 | Pump Crankshaft (Prior Art) | 4 | Diaphragm Corrugations (Prior Art) |
| 5 | Diaphragm Outside Diameter Weld Bead (Prior Art) | 5a | Diaphragm Inside Diameter Weld Bead (Prior Art) |
| 6 | Diaphragm Fluid Driver (Prior Art) | 6a | Diaphragm (Prior Art) |
| 6b | Diaphragm Inside Diameter (Prior Art) | 6c | Diaphragm Outside Diameter (Prior Art) |
| 7 | Fluid Driver Delivery System (Prior Art) | 8 | Two Stages of Pump (Prior Art) |
| 9 | Crossover Pipe (Prior Art) | 10 | Stress Limiting Diaphragm (Proposed Art) |
| 10a | Diaphragm Inside Diameter | 10b | Diaphragm Outside Diameter |
| 10c | Diaphragm Thickness | 10d | Diaphragm Curvature (Proposed Art) |
| 10e | Diaphragm Offset (Proposed Art) | 10f | Beginning of Shaped Region (ID) |
| 10g | End of Shaped Region (OD) | | |
| 11 | Wear Strip (Proposed Art) | 12 | Close Spacing between Diaphragms |
| 13 | Wear Strip Offset (Proposed Art) | 14 | Weld Bead (Same as Prior Art) |
| 15 | Unstroked Dead Volume | 16a | Internal Fluid Volume |
| 16b | Internal Fluid Volume Frustrum Height | 16c | Displacing Plug Outside Diameter |
| 16d | Displacing Plug Height | 17 | Diaphragm Input & Run Optimization |
| 18 | Pressure Entry & Dead Volume | 19 | Calculated Pressure |
| 20 | Actual Design Pressure | 21 | First Increment Boundary Conditions |
| 22 | Second Increment Boundary Conditions | 23 | Third Increment Boundary Conditions |
| 24 | Fixed Diaphragm Region after Contact | 25 | Applied Diaphragm Displacement |
| 26 | Maximum Stress Limit | 27 | Maximum Span Stress |
| 28 | Mechanical Driver Element in a Pump Application (Prior Art) | 29 | Produced Fluid Pressure and/or Flow in a Pump Application (Prior Art) |
| 30 | Innermost Radial Configuration of Proposed Art in a Pump Application | 31 | Driving Fluid Pressure and/or Flow in an Actuator Application (Prior Art) |
| 32 | Mechanical Driven Element in an Actuator Application (Prior Art) | 33 | Outermost Radial Configuration of Proposed Art in an Actuator Application |
| 34 | Actuator Pressure Vessel (Prior Art) | | |

DETAILED DESCRIPTION OF THE INVENTION

FIGS. 5 and 6

Preferred Embodiment

The preferred embodiment of the invention is the stress limiting diaphragm shape 10 (FIG. 5). Beginning at the inside diameter 10*a* (FIG. 6), a nominal radial distance is reserved for weld tooling, and the shape will be influenced solely by the requirements of the welding processes and tooling. Beyond the welding region, the diaphragm profile is defined by a computer generated (FIG. 16 and CD-ROM) compound radius 10*d*, which is S-shaped, beginning at 10*f* and ending at 10*g* (FIG. 6). The compound radius is generally governed by equations for flexural strain from pure bending moments:

$$\frac{\left(\frac{t}{2}\right)}{R} = \frac{\sigma}{E} \qquad \text{(Equation 2)}$$

where, t=Diaphragm Thickness

R=Radius of Curvature of Diaphragm Profile

σ=Stress from Flexure of Radius "R"

E=Modulus of Elasticity

An offset 10*e* is also an embodied output parameter of the Item 10*d* diaphragm shape within the 10*f*-10*g* diameter span.

The diaphragm also consists of the standard dimensions of a circular disk, such as:

a) A diaphragm inside diameter 10*a* (FIG. 6)

b) An outside diameter 10*b* c) The thickness 10*c* d) A specified material

Although the embodiment states that the diaphragm is circular, the diaphragm may be of a non-circular shape, provided that the cross-section is of a stress limiting compound radius as explained above.

The diaphragm may be made from a variety of materials, depending on the application. Metallic materials such as steel, stainless steel, copper based alloys, or nickel based alloys may be used for applications demanding higher pressure and/or temperature. Non-metallic materials such as composites, polyethylene, polypropylene, or rubber may also be used in applications where pressure and/or temperature will not debilitate the material, provided a mechanical, welding, or bonding process joins the edges of the diaphragms. Each individual diaphragm may be stamped, thermo-formed, hydraulically formed over a die, or molded, depending on the diaphragm shape, material, and most suitable process.

Additional Embodiments

FIGS. 5 and 6

The wear strip 11 (FIG. 5) is another embodiment of the invention. The wear strip may be a circular disk, and is either fixed to the diaphragm by adhesive, or may be retained by the diaphragm structure without additional securing. The inside diameter is approximately equal to the diaphragm diameter at the beginning of the shaped span 10*f* (FIG. 6). Similarly, the outside diameter is approximately equal to the diameter at the end of the shaped span 10*g*. However, the outside diameter is preferred to be less than the Item 10*g* demarcation to allow weld tool access to the outside diameter.

Other forms of wear strips (variants of 11) are also alternatively embodied. The strip may be small adhesive backed strips or dots applied intermittently along the circumference of the diaphragm span in lieu of a one-piece open center disk. Resins injected into the diaphragm plies or applied as a uniform coating to the diaphragm surface before welding are also varying embodiments. Plating or flashing may also act as an effective wear inhibitor, and as such, are embodied.

The close spacing 12 nature of the design is another embodiment. When compressed, the clearance given by 12 will reduce to approximately 0.002". The small clearance results in minimal unstroked dead volume, and generates a higher compression ratio than would be possible if greater clearances existed (see Operation, Additional Embodiments, and related discussion).

The wear strip offset 13 (FIGS. 5 and 6) is another embodiment. The offset is one half the thickness of the selected wear strip material to accommodate the placement of the strip. When assembled, the wear strip will be housed within two symmetrically placed diaphragms. The wear strip offset also is necessary to accommodate the weld bead. Under full compression, two wear strip offsets and two diaphragm thicknesses provide sufficient stacked height such that the weld bead does not interfere with the full nested compression of the diaphragms.

Although the embodiment states that the offset is one half the thickness of the selected wear strip material, the offset may be another proportion of the wear strip thickness, as long as the total offset of two paired diaphragms amounts to the total thickness of the wear strip.

Operation—Introduction to Prior Art

To understand the operation of the embodied invention, a discussion of the operation of the prior art may assist in the understanding of the more complex operation of the invention claimed. Existing bellows pumps act very similarly to piston type fluid pumps, as shown in FIG. 1. However, the primary difference is that instead of a reciprocating sliding piston and cylinder, an expandable bellows capsule 2 reciprocates, thereby eliminating a sliding mechanical joint. Several distinct advantages exist with the elimination of the sliding interface, such as:

a) No leakage to or from the external environment.

b) No wear debris or lubricant contamination of the compressed fluid.

For special fluid processing applications such as semiconductor fluid handling and processing, the advantages of bellows pumps are highly desirable. Such fluids must remain extremely pure as not to contaminate micro-electronics during manufacture. In addition, semiconductor fluids are typically highly corrosive, and in some cases, poisonous to humans. As such, elimination of a leak path to the outside environment solves very serious processing and safety problems.

Cryogenic applications also find bellows pumps very useful. Cryogenic systems employ pure high pressure (100-700 psi) compressed helium as a refrigerant. Given that cryogenic systems generate extremely cold temperatures, the helium must remain extremely pure in order for the system to function without blockage from frozen lubricating contaminants. Having no lubricated or sliding seals, bellows pumps introduce no contaminating lubricants, and therefore offer distinct advantages over conventional cryogenic pump systems.

Given in FIG. 2 is a prior art bellows capsule, consisting of a bellows capsule of diaphragms with corrugations 4. The range of stroke is limited by the available spacing between the weld beads 5 and clearances 15 (FIG. 7) required to prevent contact and subsequent wear of the diaphragms. However, even when fully compressed, the diaphragms remain spaced so as not to contact and wear the diaphragms, and therefore remain unsupported in the mid-span regions.

FIG. 7 is a finite element analysis deformed shape contour plot example illustrating the stresses generated when the prior art diaphragms are fully compressed and exposed to 100 psi of internal pressure. Maximum stresses exceeding 120,000 psi occur at the inner radial region of the diaphragms, and are excessive compared to the yield and fatigue properties of many materials, especially highly corrosion resistant materials. Furthermore, significant fluid volume 15 remains within the pressurized internal cavity of the bellows, limiting the compression ratio and efficiency of the pump.

Operation—Preferred Embodiment (FIGS. 5, 6, and 8)

The proposed art stress limiting diaphragms control stress magnitude by designing the radial cross sectional shape or profile to attain support and contact at the onset of high stress. To demonstrate the ability of the stress limiting diaphragm to mitigate high stresses, the prior art diaphragm profile (FIG. 7) was redesigned to be stress-limiting 10 (FIGS. 5 and 6). However, important features such as inside diameter 10*a*, outside diameter 10*b*, thickness 10*c*, displacement, and pressure were maintained from the diaphragm given in FIG. 7 to preserve the validity of the comparison.

FIGS. 8*a* through 8*d* finite element results illustrate the behavior of the stress-limiting diaphragms at four intervals in the compression stroke. Although the embodied diaphragm experiences pressures and deflections similar to that of the prior art diaphragms, the embodied proposed art diaphragm shape in FIG. 8*d* does not exceed the user defined limit design stress of 50,000 psi, compared to stresses of over 120,000 psi incurred by the traditional diaphragm in FIG. 7.

The shaped profile generated as Item 10 is produced by an embodied computer program (FIG. 16 and CD-ROM). More detailed discussion of the theory and the computer program is provided immediately after the "Operation—Additional Embodiments" section.

Operation—Additional Embodiments (FIGS. 5, 6, 7, and 9)

The wear strip 11 (FIG. 5) is an additional embodiment that is placed between diaphragms on the external surfaces of the capsule. The wear strips prevent wear and galling that would otherwise occur from the contact of diaphragms, and limit the design life of the diaphragm. However, wear strips are not placed on the surfaces exposed to process fluids, since the strips would be in contact with very pure and/or corrosive fluids. Furthermore, wear strips are not required on the internal surfaces, since the designed curvature of the diaphragms and the direction of any pressure forces act to slightly separate the internal surfaces from contact.

Placement of the wear strips is facilitated by the wear strip offset 13 (FIG. 5), which is another embodiment. The offset also acts to minimize un-stroked fluid volume (also an embodiment 12, FIG. 5) within stress limiting diaphragms. Without the offset, the larger weld bead 14 would prevent full compression of the diaphragms at pump top dead center, as illustrated in the prior art of FIG. 7. Reduction of top dead center un-stroked dead volume $V_1$ increases the overall compression ratio, where the fluid is a gas, more significantly than increasing the bottom dead center volume $V_2$, since $V_1$ is the denominator as shown in the equation 3.

$$\text{Compression Ratio(CR)}=(V_2/V_1)^k \quad \text{(Equation 3)}$$

Where, $V_2$=Volume at Bottom Dead Center (BDC, $in^3$)

$V_1$=Volume at Top Dead Center (TDC, $in^3$)

k=Gas Constant, assumed as 1.0 for discussion (gas isothermal process)

The internal fluid volume per pair of diaphragms, or convolution, 16*a* (FIG. 9) may be calculated by utilizing solid volume equations found on page 50 of the Machinery Handbook, 22nd edition, for a frustrum of a cone, and subtracting the fixed plug volume which displaces a portion of the internal diameter volume of the convolution cavity.

$$\text{Volume}=0.2618h(\text{OD}^2+\text{OD}\times\text{ID}+\text{ID}^2)-0.784\text{OD}_{plug}{}^2h_{plug} \quad \text{(Equation 4)}$$

Where,

OD=Outside Diameter (in)

ID=Inside Diameter (in)

h=Convolution Height 16*b* (in)

$OD_{plug}$=Displacing Plug Diameter 16*c* (in, slightly less than convolution ID above)

$h_{plug}$=Displacing Plug Height 16*d* per convolution (in)

Given that the inside diameter of the convolution is slightly larger but approximately the same as the outside diameter of the plug, and the convolution height h 16*b* when compressed at top dead center approaches the height of the plug $h_{plug}$ 16*d*, the remaining volume at top dead center would primarily reside between the diaphragms. The wear strip offset 13 (FIG. 5) further reduces the remaining top dead center volume by displacing additional fluid residing between the diaphragms, thereby increasing the compression ratio given in equation 3.

Where the fluid is incompressible, the wear strip offset 13 will increase the flow rate efficiency by evacuating more fluid from the convolution for each stroke.

Operation—Preferred Embodiment Detailed Discussion, Diaphragm Stress Limiting Profile Theory The superposition principle states that normal stresses in linearly characterized elastic structures may be analyzed in separate loading conditions, and combined to produce an overall stress and loading state. For instance, loading a structure with a given configuration of forces and displacements produces a deformed structure of a stress state that, when exposed to exactly equal and opposite forces and displacements, will experience equal and opposite stresses and deformations which will return the structure to an unloaded, undisplaced, and unstressed condition. Development of the stress limiting diaphragm profile utilizes the superposition principle by progressively loading a flat diaphragm to a predetermined maximum stress state, and extracts the deformed displacement profile at the predetermined maximum stress state. The program uses the displacement profile to establish an initial unstressed shape or contour of the stress limiting diaphragm. Under similar but reversed loading, the diaphragm's unstressed contour will return to the original flat shape, and will experience peak stresses similar but opposite to the predetermined maximum stresses of the initial loading condition. Such a concept is illustrated in cases 1, 1a, and 2.

Case 1—Loading and Restraining a Flat Diaphragm into a Deformed Shape

When exposed to a combination of a defined axial deflection and pressure, a cylindrical flat diaphragm will experience stresses and deformations of varying magnitude along the span. When span regions experience stress magnitudes that approach a user defined stress limit, the span region 24 may be theoretically fixed (FIG. 10) from further deformation, thereby preventing further increases in stress magnitude. The deformed profile is constituted when the entire span has become fixed, and the maximum deflection and pressure are attained, where all span stresses are equal to or below a user limit.

Case 1a—Unloading the Case 1 Deformed Shape

Since normal stresses and deformations are typically superimposed in subsequent loading conditions, applying deflection and pressure equal but opposite to the Case 1 loading will result in equal but opposite change in stresses and deflections, such that the plate will return to a flat shape of zero deflection and zero stress state.

Case 2—Loading and Restraining a Formed Diaphragm into a Flat Surface

An unstressed diaphragm initially of the final deformed shape of case 1, loaded identically and opposite to case 1a, and progressively restrained to a flat shape, will experience similar but opposite stresses to those given in case 1a. Therefore, since the diaphragm initially is unstressed but contoured, progressively loading the engineered diaphragm against a flat contacting plane of symmetry will produce similar peak stress, which will assure that stresses do not exceed a defined limit.

Operation—Diaphragm Stress Limiting Profile Computer Program (FIGS. 10, 11, 12, 13, 14, 15, and 16)

A diaphragm sustains displacement loading "$d_n$" and associated pressure "$P_n$" as given in FIG. 10 during load excursion "n". The stresses calculated in the shaded region 24 (FIG. 10) converge to the user defined stress limit as the displacement loading "$d_n$" is iterated. Upon convergence, the span in the shaded portion 24 becomes fixed, and the calculations in iteration "n+1" utilize the remaining reduced span, and inside diameter boundary conditions $\theta_{n+1}$ and $y_{n+1}$. The algorithm seeks a new diaphragm displacement $d_{n+1}$ and associated pressure $P_{n+1}$ such that the remaining free span achieves a stress equal to the user defined limit. The sequence continues until the entire span is defined by fixation.

Software (Stress Limiting Diaphragm.xls (FIGS. 16*a*-16*f*, and on CD-ROM) further describes and demonstrates the algorithm. In the "Run Optimization" entry area 17 (FIG. 11), the user defines:

a) the outside radius "a" (10*f* divided by 2), b) the inside radius "b" (10*g* divided by 2), c) the diaphragm thickness "t" (10*c*), d) the stress limit in kilo-pounds per square inch (ksi), In the "Pressure Entry and Dead Volume" entry area 18 (FIG. 11), the user defines:

e) the actual pump pressure at bottom dead center (BDC, from other sources, see discussion below), f) the actual pump pressure at top dead center 20 (TDC, from other sources, see discussion below), g) the diaphragm spacing 12 at TDC, h) the number of convolutions "N" (pairs of diaphragms), and i) the additional un-stroked dead volume within the bellows cavity (valve ports, etc).

Once the user is satisfied with the input, the "Run Optimization" icon may be selected to run the profiling algorithm. The first run typically verifies that the calculated TDC pressure 19 (FIG. 12) output by the algorithm matches the actual TDC design pressure 20 of the pump. If the pressures are not equal, the dead volume must be adjusted to obtain agreement between the two TDC pressure quantities 19 and 20, and the calculation must be repeated.

For clarification, please note that program does not predict the overall performance of a subject pump, but relies upon known data from other sources to interpolate pressures at points between the known top and bottom dead center pressures. For gases, the interpolation may utilize the expression $$P_n = P_{known}[(V_{known}+V_{dead})/(V_n+V_{dead})]^k \quad \text{(Equation 5)}$$

Where, $P_n$=Pressure at compression interval "n" (psia)

$V_n$=Volume 16*a* at compression interval "n" (Equation 4) ($in^3$)

$P_{known}$=Pressure at known interval (TDC or BDC) (psia)

$V_{known}$=Volume at known interval (TDC or BDC) ($in^3$)

$V_{dead}$=Dead Volume in Bellows Compression Chamber ($in^3$)

k=Fluid Constant, typically 1.15 (poly-isentropic process)

For incompressible fluids, the pressure relates to the fluid velocity, mass density, viscosity, and the overall system impedance.

$$P=f(v,\rho,\nu,I)$$

Where, v=Fluid Velocity,

ρ=Fluid Mass Density,

ν=Fluid Viscosity, and

I=Overall System Impedance.

The specific algorithms for interpolating the pressures at various stroking points are outside the scope of the embodiments herein, but are relied upon to provide known reference pressure data at and between TDC and BDC at a given pump RPM.

The maximum span stress is compared to the user defined limit, a new displacement "$d_1$" is extrapolated to bring the maximum span stress closer to the desired limit stress, and the calculation steps are repeated until the maximum stress approaches the user limit. Upon convergence to the stress limit, span region 24 attaining the user stress limit is fixed, and the calculation process repeats with a reduced length span.

FIGS. 13, 14, and 16*a*-16*f* may be referred to clarify the process of stress optimizing a diaphragm shape. In the first increment, the total active span is the entire span eligible for flexural displacement (region between 10*f* and 10*g*). The diaphragm is displaced "$d_1$" (25, FIG. 14), corresponding pressures are calculated ("$P_1$", equation 5), and stresses are calculated. The displacement "$d_1$" is adjusted, pressures are recalculated, and stresses are recomputed, to obtain a stress closer to the specified stress limit. Upon further iteration, a displacement "$d_1$" is obtained which results in a maximum stress 27 (FIG. 16) in the span region 24 which is equal to a user defined limit 26 (FIG. 16). The user defined limit typically is a given fatigue or endurance strength of the diaphragm material. Upon attainment of such as stress, the diaphragm in region 24 becomes fixed, and cannot displace further. Hence, the second increment mid-span displacements at location 22 become the new inside diameter boundary condition of the new, shortened, active span. From FIG. 13, second increment cell data replace the original first increment cell data, and are used as the new inside diameter boundary conditions.

The process repeats, monitoring third increment stresses and deflections between locations 22 and 23, and continues until the entire span becomes fixed (FIG. 15).

CONCLUSION, RAMIFICATIONS, AND SCOPE

The proposed invention permits the use of a wider range of materials and higher performance in diaphragm and bellows fluid pump and actuator applications. The predetermined diaphragm shape limits fatigue stresses through an inherently self reinforcing structural design. Such a design creates distinct and unique advantages:

a) By controlling the peak stresses in the diaphragm, pumps and actuators may use materials other than the highest strength, most highly fatigue resistant materials.

b) As such, broadening the range of candidate materials will facilitate resolution of other design concerns, including, but not limited to, greater corrosion resistance.

c) Broadening the range of candidate materials will also offer greater flexibility to manufacturing processes of the diaphragms, convolutions, and bellows capsules.

d) Also by controlling the peak stresses in the diaphragm, pumps and actuators may incur higher pressures than prior art designs are capable.

Furthermore, the proposed invention has the additional advantages in that:

e) A lubricious wear strip prevents galling and premature wear of the contacting diaphragms.

f) A wear strip offset facilitates the placement of the wear strip within the diaphragm structure, and also g) A wear strip offset permits solid compression of the capsule in the presence of an enlarged weld bead, and h) The solid compression also permits higher compression ratios in compressible fluid applications, and greater flow efficiencies in compressible fluid applications, as a result of the lower unstroked fluid dead volume inherent in the design.

Although the description above contains much specificity, these should not be construed as limiting in scope of the invention, but merely providing illustrations of some of the presently preferred and additional embodiments of this invention. For example, the benefits of the proposed invention are not limited to diaphragm and bellows fluid pump applications, or to reciprocating crankshaft devices. Various single or multi-diaphragm applications experiencing high differential pressure across a diaphragm span while stroking may benefit from the technology developed. The technology may be particularly useful to any application which would otherwise require diaphragm back pressure during the stroking process to reduce the overall differential pressure across the diaphragm. Air or fluid driven pumps, actuators, and gas pre-charged expansion tanks and accumulators which use a diaphragm, bellows, or a bladder could utilize the technology presented to mitigate partially compressed diaphragm stresses caused by high pressure differentials. In such applications, the pressure from a gas pre-charge or fluid driver could be reduced or possibly eliminated to counteract system operating pressures acting against the diaphragm or bellows while stroking.

To further distinguish the invention from prior art, the scope of the invention does not pertain to fully nested, or solidly compressed diaphragms or bellows. Expansion tanks and accumulators routinely employ solidly compressed diaphragms and bellows to counteract high differential pressures of 3,000 psi or more when exposed solely to a factory installed gas pre-charge. Although the mechanism employed by the prior art may offer similarities to the new art proposed herein when solidly compressed, the prior art can only sustain such high differential pressures in the solidly compressed condition. However, while partially compressed under high system pressures, the prior art must have a nearly equal opposing pre-charge pressure applied to the diaphragm, or the bellows or diaphragm will rupture. The invention herein does have the distinct ability to react higher differential pressures across the diaphragm when not solidly compressed, and as such, becomes the major distinguishing advantage over the prior art.

The proposed invention is not limited to compressed gases. As discussed within the specification, fluid applications also benefit from the technology. Vacuum pumps (pressures lower than atmosphere) also will benefit from the technology presented. The proposed invention is not limited to stainless steel, or other metals, and may also be applied to non-metallic materials such as ceramics, plastics, and composites.

Thus the scope of the invention should be determined by the appended claims and their legal equivalents, rather than by the examples given.

The embodiments of the invention in which an exclusive property or privilege is claimed are defined as follows:

1. A diaphragm for containing fluids such that when said diaphragm is urged by a multitude of progressively increasing compressive displacements, thereby urging progressively increasing fluid pressures within the diaphragm, the diaphragm stresses will never exceed a predetermined magnitude, comprised of a diaphragm material for containing said fluids of a flexibility and size to accommodate a multitude of said compressive displacements and said pressures urged by said compression, whereby in the unurged state, the diaphragm surface contour assigns a multitude of predetermined and disposed spacings to an adjacent member surface at a multitude of predetermined and disposed diaphragm corresponding radial positions, and also, said spacings will reduce with said urged compression, such that, when urged from said unurged state to a predetermined compressed state, said urged pressures will increase, thereby increasing the diaphragm stresses, and where said stresses at predetermined radial locations increase to said predetermined maximum permissible stress magnitude, the diaphragm spacings at said maximum stress radial locations are predetermined to reduce to zero, thereby becoming contiguous to and supported by said adjacent member surface, thereby the diaphragm stresses in the contiguous regions are prevented from increasing further above said predetermined stress magnitude.

2. The diaphragm of claim 1 wherein said means for contacting the diaphragm surface to said adjacent member surface is a wear resistant material or coating, which prevents wear or galling of said diaphragm, and is sandwiched between said diaphragms and said adjacent member surface.

3. The diaphragm of claim 2 wherein said diaphragm surface contour further includes an offset as a means for disposing said means for contacting the diaphragm surface to said adjacent member surface.

4. The diaphragm of claim 1 wherein said diaphragm is applied to a pump.

5. The diaphragm of claim 4 wherein an offset is disposed at the innermost radial region of the diaphragm, such that when said diaphragm is about fully contiguous to said adjacent member surface, about all fluid sandwiched between said innermost and the outermost radial regions of said diaphragm is displaced, so that in combination with a disposed means for displacing substantially all fluid from the center of said diaphragm to said innermost radial region of said diaphragm, the total fluid volume contained by said about fully contiguous diaphragm will be about zero.

6. The diaphragm of claim 1 wherein said diaphragm is applied to an actuator.

7. The diaphragm of claim 6 wherein an offset is disposed at the outermost radial region of the diaphragm, such that when said diaphragm is about fully contiguous to said adjacent member surface, about all fluid sandwiched between the innermost and said outermost radial regions of said diaphragm is displaced, thereby said fluid volume sandwiched will be about zero.

8. The diaphragm of claim 1 wherein said adjacent member is a symmetrically opposed and substantially similar said diaphragm, such that, when the pair, or convolution, of diaphragms is compressed against each other, the pressures, deflections, and stresses are substantially symmetrically equal in each of said diaphragms, thereby providing mutually equal and opposing support in said contiguous regions.

9. The diaphragm of claim 8 wherein a plurality of substantially identical convolutions are disposed one on top of the other to form a sandwich of convolutions, or bellows, such that when the bellows is compressed, the pressures, deflections, and stresses are substantially equal in each of said convolutions, thereby providing mutually equal and opposing support in said contiguous regions.

* * * * *